United States Patent [19]

Garrett

[11] Patent Number: 4,926,730

[45] Date of Patent: May 22, 1990

[54] GUIDE FOR SLOTTING, SCORING, TRIMMING OR LIKE HEADS

[76] Inventor: Jimmy R. Garrett, Rte. 1, Box 569, Worden, Ill. 62097

[21] Appl. No.: 238,204

[22] Filed: Aug. 30, 1988

[51] Int. Cl.[5] ..... B26D 3/08; B26D 1/24

[52] U.S. Cl. ..... 83/499; 83/504; 83/508.2; 83/699; 384/620; 384/621; 493/403; 493/471; 493/475

[58] Field of Search ..... 83/498, 499, 501, 502, 83/504, 508.3, 824, 825, 508.2, 699; 493/402, 403, 471, 475, 354, 370; 384/618, 619, 620, 621

[56] References Cited

U.S. PATENT DOCUMENTS

| | | | |
|---|---|---|---|
| 2,259,441 | 10/1941 | Fitchett | 101/216 |
| 2,598,649 | 5/1952 | Rintoul | 164/70 |
| 2,674,942 | 4/1954 | Rockstrom | 101/247 |
| 3,587,371 | 6/1971 | Sherwood | 82/44 |
| 4,211,135 | 7/1980 | Wehde | 83/504 X |
| 4,515,052 | 5/1985 | Flaum | 83/504 X |

*Primary Examiner*—Hien H. Phan

*Assistant Examiner*—Kenneth E. Peterson

*Attorney, Agent, or Firm*—Grace J. Fishel

[57] ABSTRACT

A guide for slotting, scoring, trimming, or like heads mounted in mating relationship in a slotter for scoring a cardboard blank on the fold lines and slotting, timming or the like of the blank between the various flaps so that it may be folded into a box, carton or the like. The guide includes a plate with an arcuate bearing surface which is adapted to ride along the bottom of a peripheral groove having a bottom and sidewalls provided therefor in the heads. The plate portion of the guide is thinner than the groove is wide and has a plurality of recesses in its opposite side faces into which rollers are mounted for rotation off the side centerline thereof. the rollers exert a balanced radial thrust on the sidewalls of the groove aligning the head. At least some of the rollers are preferably eccentrically adjustable about their axis of rotation such that contact can be established and maintained between the rollers and the sidewalls of the groove and the heads are thereby laterally fixed on their respective shafts.

7 Claims, 2 Drawing Sheets

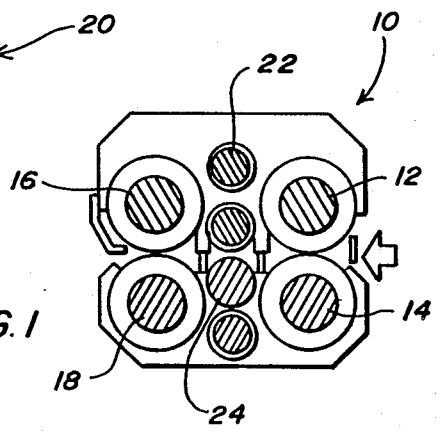
FIG. 1
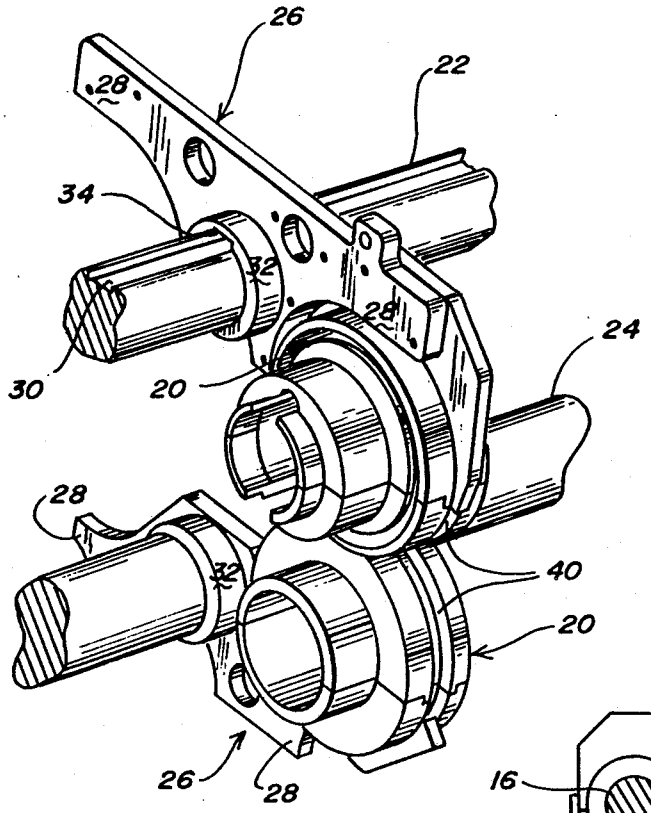
FIG. 2
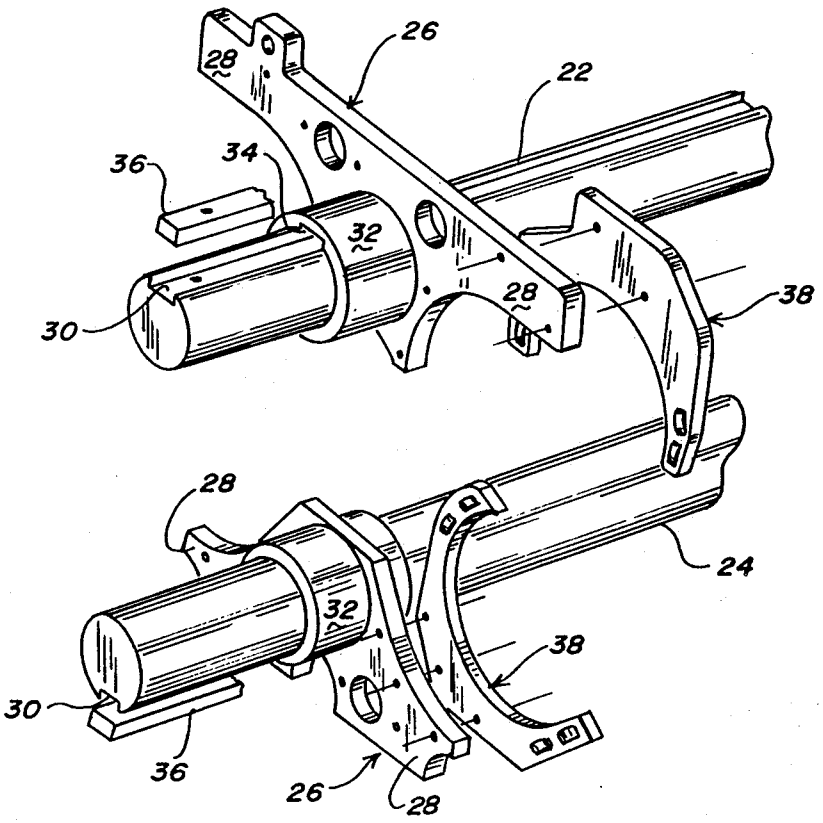

GUIDE FOR SLOTTING, SCORING, TRIMMING OR LIKE HEADS

BACKGROUND OF THE INVENTION

Boxes or cartons are generally made from cardboard by cutting a cardboard blank to the outside dimensions of the various walls and flaps, scoring the blank on the fold lines and slotting the blank between the various flaps so that it may be folded readily between the various walls and between the walls and flaps. In conventional box or carton forming equipment, the slotting and scoring heads are mounted in mated condition on two pairs of shafts. The slotting and scoring operations, in some instances along with trimming or the like, take place serially as the blank is fed into the nip between the paired shafts. Such that different sized boxes can be made on the same machine, the slotting and scoring heads are slidable on their respective shafts. Some provision must be made for holding them in selected position, however, for good cutting and, to some extent, good creasing action. In this connection, for example, it is particularly critical that the knives on the upper slotting heads be received cleanly in the lower or female slotting heads.

Conventionally, lateral movement of the slotting, scoring, trimming or like heads is controlled by guides which are received in a peripheral groove provided for this purpose in each head. As the guides and the grooves wear, however, the heads can move on their shafts causing misalignment as described above. This can be remedied by changing the heads and replacing the guides but the parts are costly and the cure takes the machine out of operation for a lengthy period of time.

In view of the above, there is a need for an improved guide which causes minimal wear and which can be adjusted in place on the machine for such wear as occurs. It is therefore an object of the present invention to provide such a guide. Other objects and features of the invention will be in part apparent and in part pointed out hereinafter.

The invention accordingly comprises the constructions hereinafter described and their equivalents, the scope of the invention being indicated in the following claims.

SUMMARY OF THE INVENTION

The present invention relates to an improved guide for maintaining the alignment of slotting, scoring, trimming or like heads used for slotting, scoring, trimming or the like of a cardboard blank so that it may be folded into a box, carton or the like. Guides in accordance with the present invention include plates with an arcuate bearing surface with opposite side faces. The arcuate bearing surface is adapted to ride along the bottom of a peripheral groove having a bottom and sidewalls provided in the heads. The plate portion of the guide is thinner in cross section than the groove is wide and rides on the sidewalls of the groove on a plurality of rollers mounted for rotation off the side centerline of the plate in recesses on the opposite side faces thereof. Contact between the rollers and the sidewalls is established and maintained by adjustment of the axis of rotation of the rollers towards or away from the sidewalls of the groove.

BRIEF DESCRIPTION OF THE DRAWINGS

In the accompanying drawings, in which one possible embodiment of the invention is illustrated, corresponding reference character, refer to corresponding parts throughout the several views of the drawings and in which:

FIG. 1 is an end view, partly in section, of a slotter for slotting, scoring, trimming or the like of cardboard blanks;

FIG. 2 is a perspective view, partly exploded, showing guides in accordance with the present invention for holding the slotting, scoring, trimming or like heads;

DETAILED DESCRIPTION OF THE INVENTION

Figure 3:
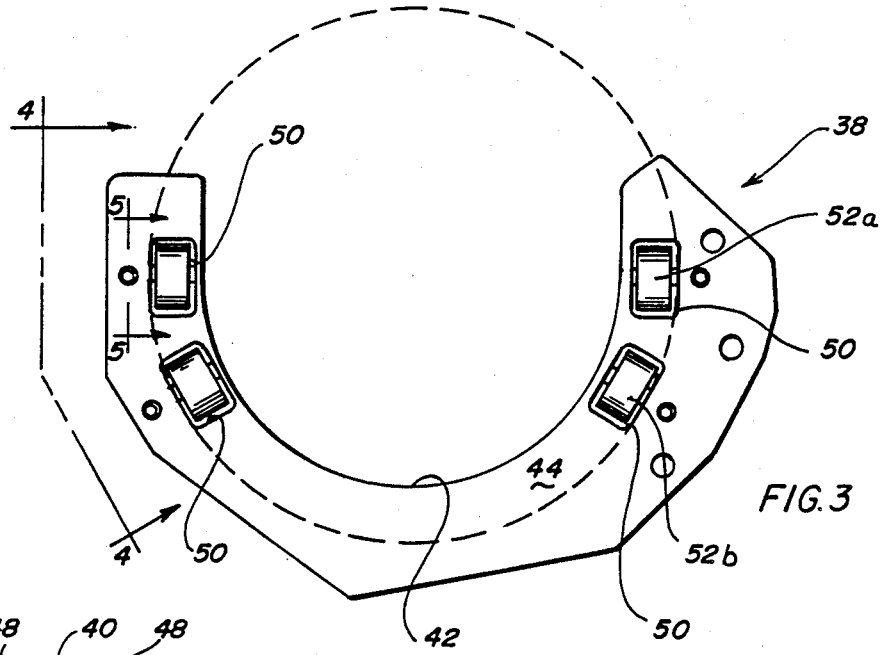
FIG. 3 is a plan view of a guide.

Referring to the drawings more particularly by reference character, reference numeral 10 refers to a slotter having upper and lower rotating shafts 12, 14 with creasing or scoring heads (not shown) and upper and lower rotating shafts 16, 18 with slotting, trimming or like heads 20 as shown in FIG. 2. Fourth and fifth stationary shafts 22, 24 are located parallel to and between upper shafts 12, 16 and lower shafts 14, 18, respectively.

As best seen in FIG. 2, mounted on shafts, 22, 24 are movable T-shaped brackets 26 with cross arms 28. Each of shafts 22, 24 includes a longitudinal groove 30 and each of brackets 26 is centrally mounted on shafts 22, 24 by a collar 32 with an internal slot 34. A key 36 fits in groove 30 and when received in slot 34 locks each of brackets 26 from rotation on shafts 22–24. Brackets 26 can be moved laterally along shafts 22, 24 by means of lead screws (not shown) attached to brackets 26 through suitable couplings (not shown).

Yokes or guides 38 in accordance with the present invention and more particularly described hereinafter extend downwardly from cross arms 28 of brackets 26 on shaft 22 and upwardly from cross arms 28 of brackets 26 on shaft 24. As shown in FIG. 2 taken in combination with FIG. 3, guides 38 are received in grooves 40 of heads 20. For clarity of illustration only the grooved portion of heads 20 is shown in FIGS. 2 and 3. Comparable grooves (not shown) are provided in the scoring heads for receipt of guides 38.

Figure 4:
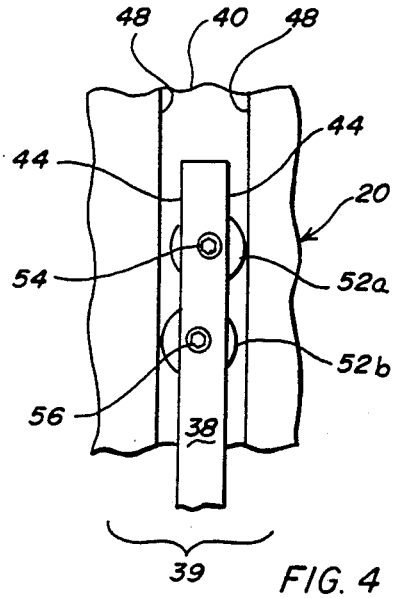
FIG. 4 is an end view of the guide taken along line 4—4 in FIG. 3.

With reference to FIGS. 3–7, yokes or guides 38 include plate 39 with a crescent shaped or arcuate bearing surface 42 and opposite side faces 44. As shown in FIG. 4, plate 39 is thinner in cross-section than grooves 40 are wide such that there is clearance between sidewalls or shoulders 48 and opposite side faces 44.

Recesses 50 are provided in opposite side faces 44 of plate 39. Small rollers or roller bearings 52 are mounted in recesses 50. Since sidewalls 48 are hardened, it is preferred that roller bearings 52 also be hardened and have hardened races. Rollers 52 have a diameter which is less than the width of grooves 40 and are mounted off the side centerline of plate 39 such that rollers 52 protrude more on one side than the other. To prevent wobble, at least three and preferably four rollers 52 are provided, two at opposite ends of plate 39, so that yokes 38 ride on rollers 52 and otherwise make no contact with shoulders 48 of grooves 40. So positioned, roller bearings 52 exert a balanced radial thrust on sidewalls 48 and align heads 20.

Figure 5:
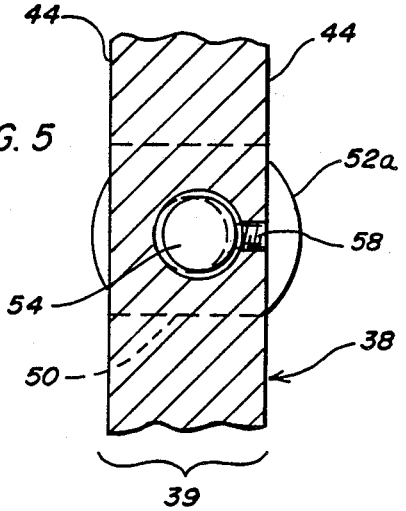
FIG. 5 is a sectional view taken along line 5—5 in FIG. showing a roller mounted on a cam pin.
Figure 6:
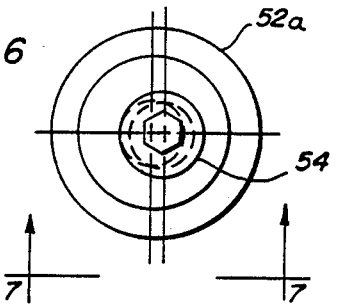
FIG. 6 is an end view of the cam pin and roller assembly.
Figure 7:
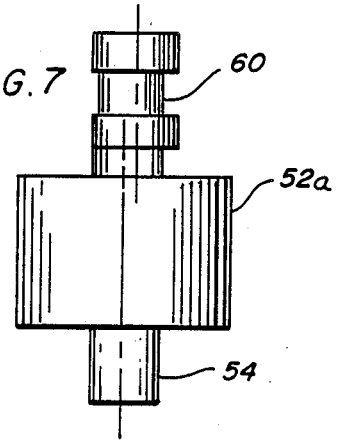
FIG. 7 is taken along line 7—7 in FIG. 6.

For installation of yokes 38 in grooves 40 and to compensate for such wear as occurs during use, a portion of rollers 52 have means for adjustment of its axis of rotation towards or away from sidewalls 48. As shown in FIGS. 4–7, this can be accomplished by mounting upper rollers 52*a* on cam pins 54 and lower rollers 52*b* on fixed pins 56. With lower roller 52*b* abutting shoulder 48, rotation of cam pin 54 eccentrically shifts the axis of rotation of upper roller 52*a* towards shoulder 48 until roller 52*a* makes contact. For this to occur, the throw of cam pin 54 must be equal to or greater than the clearance between roller 52*a* and shoulder 48. Once roller 52*a* is in contact with shoulder 48, means are provided to maintain roller 52*a* in selected adjustment. This can be accomplished as shown in Figs. 5 and 7 with a set screw 58 tightened into a groove 60 provided in the shank of cam pin 54.

In use, cardboard blanks are fed into slotter 10 right to left as shown in FIG. 1. The blank is scored by the scoring heads on shafts 12, 14 and then slotted, trimmed or the like by slotting, trimming or like heads 20 on shafts 16, 18. If the position of the score and slotting, trimming or the like lines needs to be changed, the scoring heads and slotting, trimming or like heads 20 are moved on their respective shafts 12, 14 and 16, 18 by means of guides 38 which are pulled by brackets 26 along shafts 22, 24. Once the upper and lower heads are brought into mesh during the initial set up of the machine, they remain in mesh even during extremely long runs as rollers 52 cause very little wear on grooves 40 and, in consequence, the contact between rollers 52 and shoulders 48 remains tight. Such little wear that does occur can be easily compensated for by adjustment of rollers 52 without removing yokes 38 or the heads from the machine.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A guide for slotting, scoring, trimming or like heads, said heads having a peripheral groove with a bottom and sidewalls and said guide including a plate with an arcuate bearing surface adapted to ride along the bottom of the peripheral groove provided therefor in the heads, said plate having opposite side faces and being thinner in crosssection than the groove is wide, said plate further having a plurality of recesses in the opposite side faces into which rollers are mounted for rotation off a side centerline of said plate, at least some portion of which rollers include means for adjustment of the roller's axis of rotation towards or away from the sidewalls of the groove.

2. The guide of claim 1 wherein means are provided to maintain the rollers in selected adjustment.

3. The guide of claim 2 wherein the means for adjustment comprises a cam pin and wherein the means to maintain the rollers in selected eccentric adjustment comprises a set screw.

4. The guide of claim 1 wherein the rollers exert a radial thrust on the sidewalls of the groove thus aligning the head.

5. In a slotter having slotting and scoring, trimming or like heads mounted in mated condition on two pairs of shafts and wherein the slotting and scoring, trimming or like heads are moved on their respective shafts by means of guides, said heads having a peripheral groove with a bottom and sidewalls, the improvement which comprises a guide including a plate with an arcuate bearing surface adapted to ride in the bottom of the peripheral groove provided therefor in the slotting heads, said plate having opposite side faces and being thinner in cross-section than the groove is wide, said plate further having a plurality of recesses in the opposite side faces into which rollers are mounted for rotation off a side centerline of said plate, at least some of which rollers include means for eccentric adjustment of the roller's axis of rotation and means to maintain the rollers in selected eccentric adjustment.

6. The slotter of claim 5 wherein there are four rollers on said guide, two of which are mounted near the end of the arcuate bearing surface on opposite side faces of the plate, one on a fixed pin and one on a cam pin serving as the means for eccentric adjustment.

7. The slotter of claim 6 wherein the rollers exert a radial thrust on the sidewalls of the groove thus aligning the head.

* * * * *